US005586690A

United States Patent [19]

Ettore et al.

[11] Patent Number: 5,586,690

[45] Date of Patent: Dec. 24, 1996

[54] BULK CONTAINER WITH REMOVABLE LINER, DISCHARGE FITMENT FOR THE LINER, AND ADAPTER FOR CONNECTION TO DISCHARGE PORT OF THE CONTAINER

[75] Inventors: Steven P. Ettore; Joseph J. Lane, both of Marietta; Douglas S. Vandergriff, Woodstock, all of Ga.

[73] Assignee: 21st Century Containers, Ltd., Atlanta, Ga.

[21] Appl. No.: 305,939

[22] Filed: Sep. 19, 1994

[51] Int. Cl.[6] ..... B65D 35/56

[52] U.S. Cl. ..... 222/105

[58] Field of Search ..... 222/105, 106, 222/183, 107

[56] References Cited

U.S. PATENT DOCUMENTS

| | | | |
|---|---|---|---|
| 607,316 | 7/1898 | Winters | 285/206 |
| 3,108,732 | 10/1963 | Curie et al. . | |
| 3,226,002 | 12/1965 | Walker . | |
| 3,372,725 | 3/1968 | Voorhees | 222/105 X |
| 3,448,889 | 6/1969 | Malpas . | |
| 4,640,535 | 2/1987 | Hermann | 285/87 X |
| 4,771,917 | 9/1988 | Heaps, Jr. et al. | 222/105 X |
| 4,934,654 | 6/1990 | Linnemann . | |
| 4,960,227 | 10/1990 | Coleman | 222/105 X |
| 4,997,108 | 3/1991 | Hata | 222/105 |

*Primary Examiner*—Andres Kashnikow
*Assistant Examiner*—Kenneth Bomberg
*Attorney, Agent, or Firm*—Fitzpatrick, Cella, Harper & Scinto

[57] ABSTRACT

A lined container includes a rigid-walled vessel having a discharge port, a flexible liner having a discharge fitment, and an adapter for connecting the discharge fitment to the discharge port of the vessel. The adapter includes a tubular member having a coaxial bore and a set of male, tapered threads for engaging with female, tapered threads of the discharge fitment of the flexible liner. The adapter also includes a flange member for accommodating a sealing ring abutted against an inner wall of the rigid walled vessel. A method of inserting the liner and adapter into the rigid vessel includes guiding the adapter (with liner attached), using a guide leash, through a top aperture, into the vessel, and then out the vessel through the discharge port (leaving just the liner inside).

11 Claims, 5 Drawing Sheets

BULK CONTAINER WITH REMOVABLE LINER, DISCHARGE FITMENT FOR THE LINER, AND ADAPTER FOR CONNECTION TO DISCHARGE PORT OF THE CONTAINER

BACKGROUND OF THE INVENTION

1. Field of the Invention

This invention relates to a bulk container and a removable liner for storing and shipping fluid and semi-fluid materials in bulk, such as fluid and semi-fluid adhesives, polyester resins or the like, paints, photosensitive lithographic compounds, foodstuffs, etc.

In storing and shipping fluid and semi-fluid materials, it is preferable to utilize containers, such as drums, intermediate bulk containers, and bulk containers varying in size from about 30 to 1000 gallons. Due to the expense in manufacturing such large containers, it is preferable to reuse the containers as often as possible. However, if the material is stored directly inside the container, the container would desirably need to be cleaned after each use. Such cleaning can be very difficult (and therefore costly) to carry out and sometimes impossible to accomplish effectively, depending upon the type of material used. With some materials, if a delay is anticipated before cleaning can be effected, it is necessary to fill the container completely with some type of solvent, such as water or acetone, after the supply of the material is exhausted, so that the residual material will not harden against the interior walls of the container and make such cleaning even more difficult. Some solvents, such as acetone, may be classified as a hazardous material that requires strict disposal procedures, thereby making cleaning even more costly.

Furthermore, some materials may be more chemically incompatible with the container, depending upon the composition of the container. Likewise, some materials may chemically react with the container and contaminate the stored material. Moreover, some materials are not authorized to be used in food grade applications.

In order to resolve these problems, it has been proposed to coat the interior walls of bulk containers with a composition that will prevent undesired chemical reactions between the stored material and the interior container walls, such as corrosion, and to provide a more readily cleanable surface. However, such coating involves a complex process and the integrity of the coating cannot always be guaranteed. If an undetected pin hole exists in the coating, an undesirable chemical reaction between the stored material and the container may occur, thus contaminating the entire contents of the container. Also, the walls of the container may corrode and even rupture. In addition, it is still somewhat difficult to clean the interior of the container, especially if there is limited access to it.

It has also been proposed to construct bulk containers out of different materials, specifically selected according to the composition of the material to be stored. However, such a strategy is costly, especially if containers for a wide variety of materials are desired. Also, some materials for forming the container may have better strength attributes than other materials, thus requiring different wall thicknesses.

Further, an unlined container must be painstakingly cleaned if it is desired to be reused—especially if it is to be used for different contents.

Therefore, it is generally preferred to utilize a removable liner in the bulk containers. Removable liners can protect the container from corrosion by the stored material and can prevent contamination of the stored material by acting as a barrier between the container and the stored material. Further, when the supply of stored material is depleted, the liner, being less massive and, therefore, relatively inexpensive, can be removed and simply disposed of. A new liner can then be inserted and the bulk container can be reused without any need for cleaning. The bulk container can be mass-produced using one preferred material, and one set of parameters for wall thickness, whereas several liners can each be made of a different material, depending upon the type of material to be shipped or stored. That is, each bulk container can be used, during its lifetime, for storing more than one type of liquid because only the liner need be changed.

A typical liner includes an inlet fitment and a discharge fitment and there is a need to connect the discharge fitment of the liner with a discharge port of the bulk container. An adapter has been proposed for connecting the discharge fitment of the liner with the discharge port of the bulk container. One type of adapter that had been designed by inventors of the present invention is shown in FIG. 9 of the drawings accompanying this specification. Referring to FIG. 9, adapter 100 includes an inner cylinder 102 and an outer cylinder 104. The outer cylinder 104 is connected to the inner cylinder 102 via a flange 106. On a first or proximal end of the inner cylinder a first set of male, tapered threads 108 is provided. On the second or distal end, a second set of male, tapered threads 110 is provided. In addition, a third set of male, tapered threads 112 is provided on the outer cylinder 104. (The tapers are not shown to scale in the drawings. They can be made to pipefitting standards.) In installing the liner in the bulk container, the adapter 100 must be aligned with the discharge fitment on the liner as it is screwed into the discharge port of the bulk container. It may be necessary to have an aide crawl into the container and hold the discharge fitment in position. The installer then rotates the adapter 100 to simultaneously engage the threads 108 with the discharge fitment and the threads 104 with female threads on the discharge port on the bulk container. After the adapter is tight, a valve can be installed by engaging with threads 110 from outside the bulk container.

Such an assembly process proved tedious and difficult to accomplish. In many bulk containers access can be very limited. Further, simultaneously engaging the threads of the discharge fitment on the liner and the threads of the discharge port with the different sets of threads of the adapter is very difficult if the components are not perfectly aligned, and sometimes requires several attempts. After the adapter is disconnected, residual stored material may leak through the discharge fitment of the liner and drip into the bulk container before the liner can be withdrawn, thereby requiring cleaning.

Furthermore, a typical discharge fitment on a flexible liner, which is in essence a spout to which a valve can be attached, is relatively long in comparison to its diameter. Therefore, when such a discharge fitment is engaged with the adapter 100, which in turn is threaded in the discharge port of the bulk container, the portion of the liner surrounding the discharge fitment must necessarily be disposed a significant distance back from the rigid wall of the container. When the container is filled, the static pressure within the liner due to the weight of the filled material tends to stretch that region of the liner toward the container walls, thereby giving rise to a potential of tearing the unsupported liner at that location.

SUMMARY OF THE INVENTION

It is thus an object of the present invention to provide an adapter between a liner and a bulk container that can be more readily installed, in particular, in a bulk container with limited access to its interior. It is a further object of the present invention to prevent leakage from the liner when the empty liner is removed. It is another object of the present invention to provide an adapter that can readily seal effectively at all engagements with a minimum number of parts. It is also an object of the present invention to provide an adapter that will contain the stored material in the event the liner ruptures within the container.

To achieve the above objects, one aspect of the present invention relates to an adapter for connecting a flexible liner having a threaded discharge or fill fitment to a port of a rigid container having an inner wall and an outer wall. The adapter includes a tubular member and a flange member. The tubular member has a proximal end, a distal end and a coaxial bore. The proximal end of the tubular member has a first set of threads for engaging with the threads on the fitment of the flexible liner, and the tubular member has near its distal end a second set of threads for engaging with a threaded securing member that abuts against the outer wall of the rigid container when in its securing position. The flange member is secured to the tubular member for abutting against the inner wall of the rigid container.

Another aspect of the present invention relates to a lined container including a rigid-walled vessel, a flexible liner and an adapter. The rigid-walled vessel has a port formed in its wall. The flexible liner has a discharge or fill fitment integrally provided therewith, the fitment having female threads. The adapter includes a tubular member having a proximal end, a distal end, and a coaxial bore, for connecting the fitment of the flexible liner to the port of the vessel, and a flange member, secured to the tubular member, for abutting against an interior surface of the wall of the vessel.

Still a further aspect of the present invention relates to a method of lining a rigid container, having an access aperture and a discharge port, with a flexible liner, having a discharge fitment. The method includes a first step of affixing a plug with a tow-line to the fitment of the flexible liner. The tow-line has a free end. Next, the free end of the tow-line is guided through the access aperture into the rigid container and then through the port and out of the rigid container. The flexible liner is fed through the access aperture into the rigid container. Then the tow-line, while still attached to the fitment, is pulled completely through the port of the rigid container. Lastly, the fitment of the flexible liner is secured to the port of the rigid container.

Yet another aspect of the present invention relates to a fitment for an opening of a flexible liner for lining a rigid container having a port. The fitment includes a tubular member and a flexible flange. The tubular member has an internal bore therethrough, the tubular member including means for connecting the fitment to the port of the rigid container. The flexible flange is provided integrally with the tubular member, for affixing the fitment to the flexible liner at its opening, wherein a ratio between the outer diameter and the length of the tubular member is no less than 2.7 to 1.

These and other objects and aspects of the present invention will be apparent from the drawings and the following description.

DETAILED DESCRIPTION OF THE PREFERRED EMBODIMENT

Figure 1:
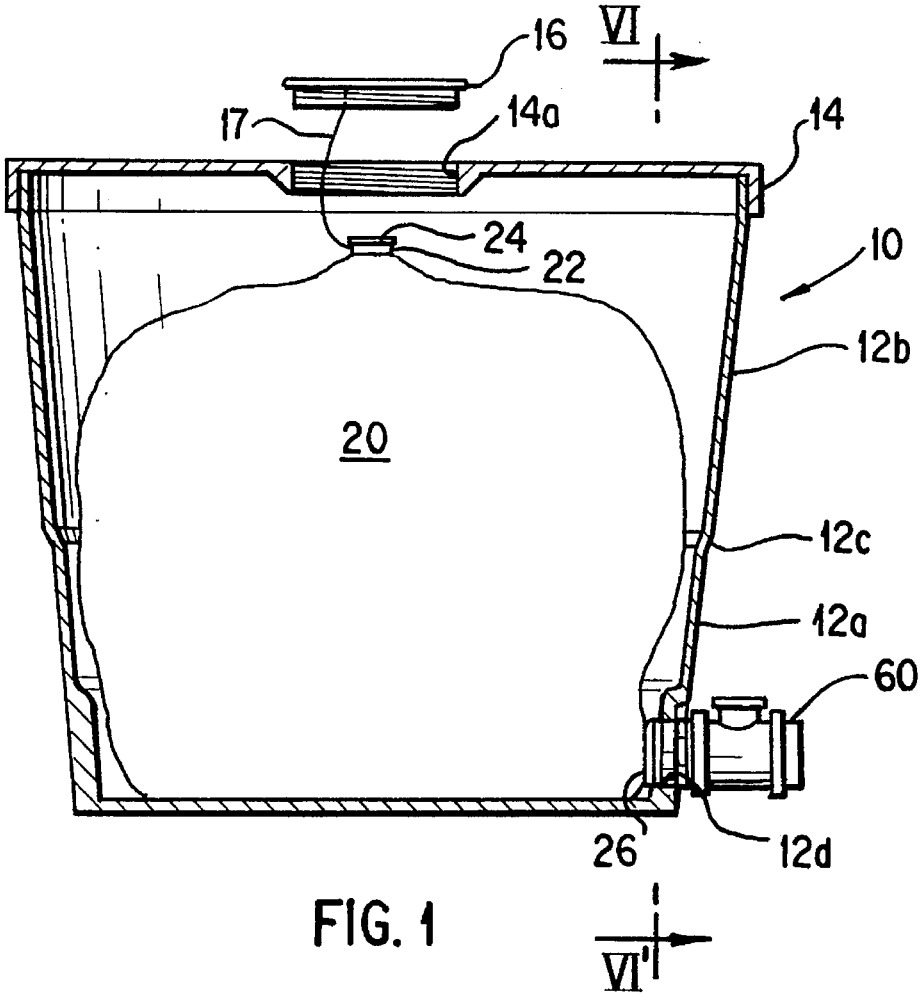
FIG. 1 is a cross-sectional view of a bulk container of the present invention with a liner installed.

Referring now to FIG. 1, a bulk container 10 to which the present invention is particularly applicable is depicted. Container 10 can be formed of any suitable structural material, for example strong plastic or steel. Preferably, however, it is made of a dicyclopentadiene polymer and can be configured and made as described in International Patent Publication No. WO 92/21575 (Brown et al.) and the various U.S. patents that are referenced therein (viz., U.S. Pat. Nos. 4,400,340; 4,436,858; 4,469,809; 4,481,344; 4,485,208; 4,507,453; 4,520,181; 4,598,102; 4,607,077; 4,657,981; 4,661,575; 4,703,098; 4,708,869; 4,710,408; 4,727,125; 4,740,537; and 5,087,343), all of which are hereby incorporated by reference. Dicyclopentadiene polymers are formed, and molded into the desired shape, by a closed molding process using a core and cavity, called reaction injection molding (RIM).

The bulk container 10 is typically formed with a lower section 12*a* and an upper section 12*b*, with a shoulder 12*c* disposed therebetween. The lower section 12*a*, upper section 12*b* and shoulder 12*c* are integrally formed. The shoulder 12*c* adds strength to the container.

The container lid 14 is affixed onto a rim of the bulk container in an airtight manner such that the bulk container can withstand internal pressures up to about 15 p.s.i., if necessary. The container lid 14 includes a cap 16 which has male threads that fit into female threads of an access aperture 14*a* centrally located in the container lid 14. The lid 14 and the cap 16 may also include one or more bung plugs which fit into corresponding bung holes. A lanyard 17, to be described later, has one end affixed to the cap 16.

A liner 20 is insertable into the bulk container. The liner includes an inlet fitment 22 and a bung plug 24 that fits into the inlet fitment in a sealing manner. The other end of the lanyard assembly 17 is connected to the inlet fitment 22 of the liner, such that the liner will not drop completely down to the bottom of the bulk container either before the liner is filled or as its contents are depleted. The liner also includes a discharge fitment 26 provided at a lower end thereof.

Figure 2:
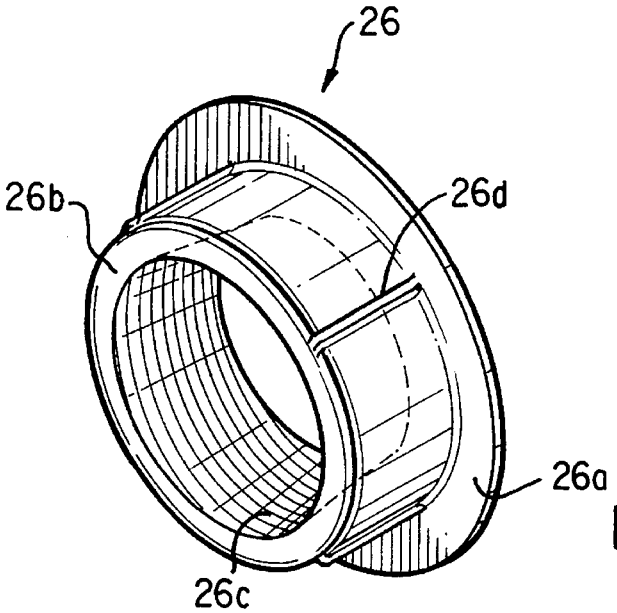
FIG. 2 is a perspective view of the discharge fitment of the liner of the present invention.

The discharge fitment 26 of the liner 20, as shown in FIG. 2, includes a flange 26*a*, a tubular member 26*b* having a coaxial bore 26*c* lined with tapered female threads, and ribs 26*d*. The flange 26*a* is formed integrally with the tubular member 26*b* of injection molded, low density polyethylene, for example. The fitment can be fused to the liner 20 by heating or ultrasonic welding or can be adhered to the liner with an adhesive. Ribs 26*d* facilitate the molding process by preventing the fitment from rotating during molding. Ribs 26*b* are not necessary if the fitment is machined rather than molded. The outer diameter of the tubular member 26*b* is sized such that it is no less than 2.6 times the length of the tubular member measured from the flange 26*a* to the free end of the tubular member 26*b*. As a result, the fitment has a relatively small profile, the advantages for which will be explained later. In addition, the flange 26*a* is formed as a thin layer so that it can readily flex with the liner 20. The advantages of this feature will also be explained later. Further, the average inner diameter of the tubular member is no more than 9.5 times the average thickness of the tubular member (i.e., the distance between the inner and outer diameters). As a result, the tubular member of the fitment is sufficiently strong without any need for other structural support.

Figure 3:
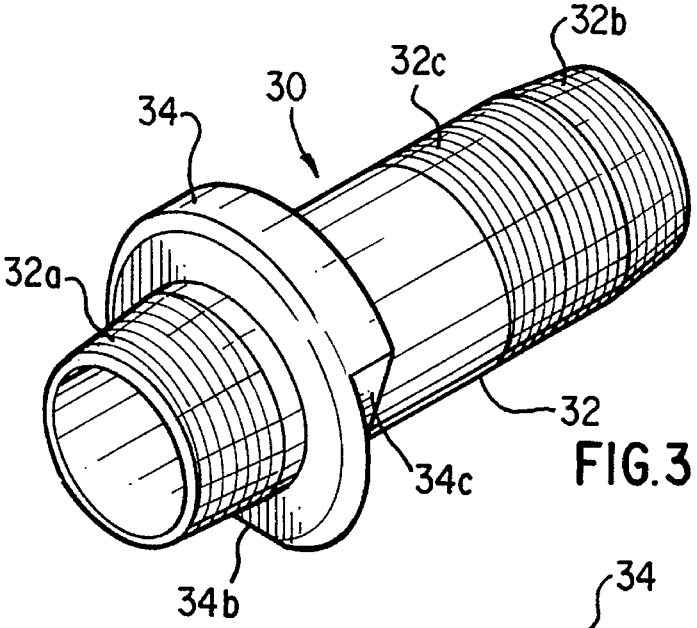
FIG. 3 is a perspective view of the adapter assembly of the present invention.
Figure 4:
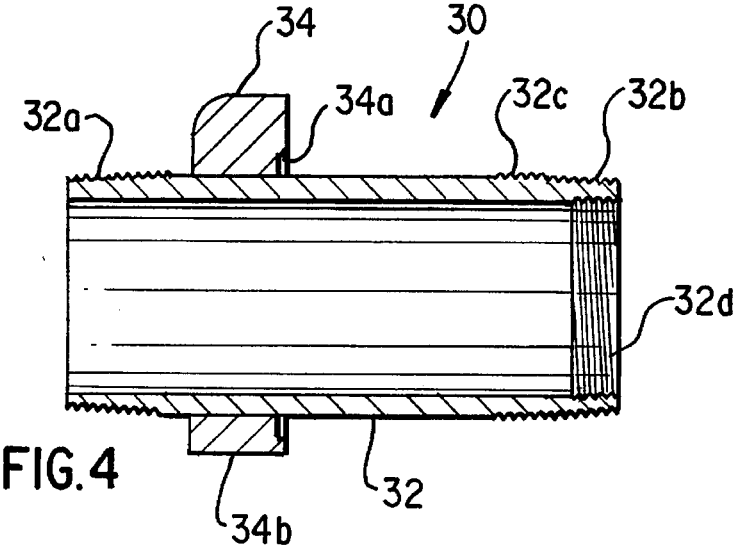
FIG. 4 is a cross-sectional view of the adapter assembly of the present invention.

The discharge fitment 26 of the liner 20 is connected to the discharge port 12*d* of the bulk container 12 via an adapter assembly 30 shown in FIGS. 3 and 4. The adapter assembly 30 includes a main cylinder or tubular member 32 and a flange 34. The flange is affixed to the cylinder member 32 at a midpoint thereof by any suitable method, depending on the type of material used. The cylinder member 32 includes a male, tapered, first set of threads 32*a* on a first or proximal end of the cylinder, a male, tapered, second set of threads 32*b* formed continuously with a male, straight, third set of threads 32*c* on a second or distal end of the cylinder, and a female, straight, fourth set of threads also on the second end.

The first set of threads 32*a* is for connection with the discharge fitment 26 of the liner 20. The interconnected tapered threads provide an interference fit between the discharge fitment of the liner and the adapter assembly, thereby eliminating the need for a sealing gasket. Nevertheless, some type of sealant, such as Teflon™ tape or pipe sealant, is preferred to be provided on the threads before the interconnection is established. The second set of threads 32*b* is for connection with a female-threaded valve 60 to be described later. These tapered threads 32*b* also provide an interference fit.

The straight threads 32*c* are for connecting with a retaining nut. The fourth set of threads are tapped into the inner periphery of the adapter assembly near the second end thereof. The fourth set of threads is for engaging a plug 70 for the adapter assembly.

The flange 34 is disposed near the proximal end of the main cylinder 32, where the first set of threads 32*a* is provided. This minimizes the profile of the discharge fitment 26 and the portion of the adapter assembly that is disposed within the rigid container, providing advantages which will be explained later. The flange 34 includes a recess 34*a* on its distal face that functions as a seat for a sealing ring. The flange 34 also includes flats 34*b* and 34*c* on its circumference. At least flat 34*b* is disposed close to a complementary flat in the inside of the bulk container, such that the adapter assembly cannot rotate after it is properly positioned.

The adapter assembly 30 can be formed of any material that will suit the requirements for its use, as long as the selected material is compatible with the connections to the discharge fitment 26, the valve, the retaining nut and the plug. For example, if the container is to be used for storing some type of fluid foodstuff, food grade PVC can be used to form the adapter assembly. This type of PVC is compatible with a polyethylene liner fitment, a UHMW lock nut, a polypropylene plug, and a food grade polypropylene valve fitment. For other types of materials to be stored, the adapter assembly can be suitably formed of polypropylene, stainless steel, carbon steel, brass, etc.

Figure 5:
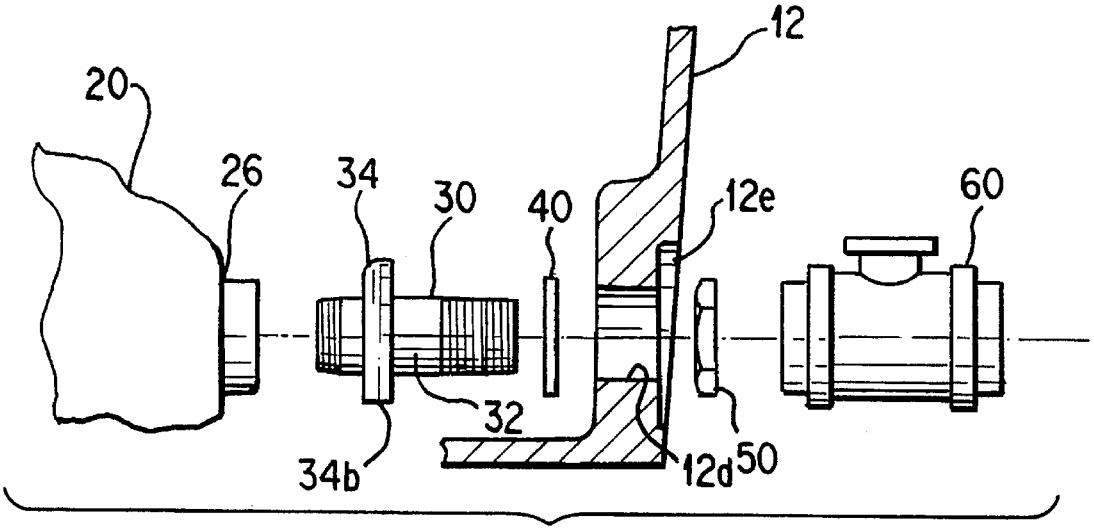
FIG. 5 is an exploded cross-sectional view of the liner, adapter assembly, bulk container and valve of the present invention.

FIG. 5 is an exploded view illustrating the interrelationship of the various elements of the preferred embodiment of the present invention. When fully assembled, the fitment 26 of the flexible liner 20 is threadedly engaged with the first set of threads 32*a* of the adapter assembly 30. Flat 34*b* is positioned parallel to the flat bottom of the rigid vessel 12, with little or no clearance between them. This prevents the adapter assembly from rotating after it is inserted through the port 12*d* of the container 12, which in turn prevents the flexible liner 20 from twisting and possibly restricting its flow. Instead of a flat, any geometric shape and a complementary recess on the inside of the container can be utilized. A sealing ring 40, which is formed of nitrile, for example, is disposed between the flange 34 of the adapter assembly 30 and the inner wall of the container 12 and sits in recess 34*a*. Therefore, even if the flexible liner were to accidentally rupture, its contents would still be reliably retained within the rigid walled container.

Figure 7:
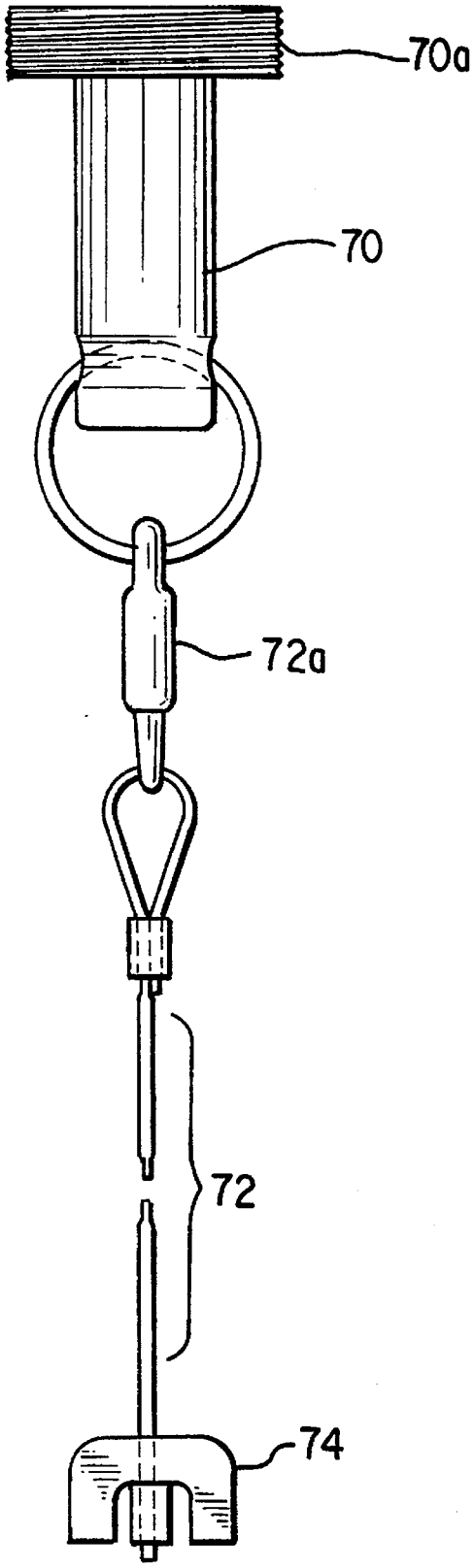
FIG. 7 is an elevational view of the plug and tow-line assembly of the present invention.
Figure 9:
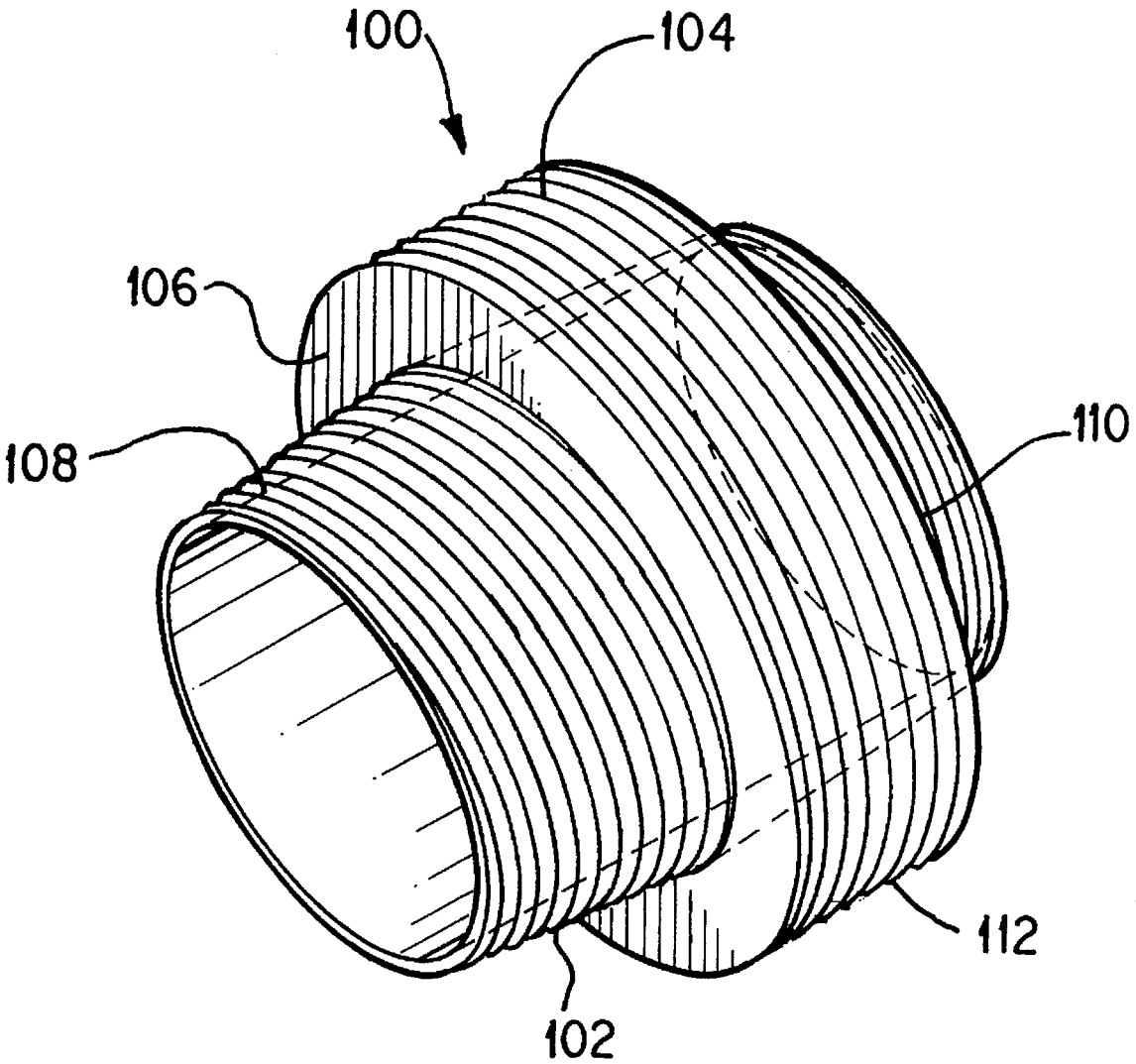
FIG. 9 is a perspective view of a previously proposed adapter assembly.

When the adapter assembly is inserted through the bore 18 of the vessel and the flat 34*b* of flange 34 is seated against the bottom of the container, a retaining nut 50 is threaded onto the straight set of male threads 32*c* of the adapter assembly 30 to hold the adapter assembly in place. The nut 50 abuts against a flat surface 12*e* of the container. A ball valve 60, which can be formed of polypropylene or stainless steel, for example, is threadable on the tapered threads 32*b* thereafter. The interconnected tapered threads of the adapter assembly 30 and the valve 60 also provides an interference fit which can be enhanced with a sealing material such as Teflon™ tape. When the valve 60 is not connected to the adapter assembly, the plug assembly 70, having male threads 70*a*, as shown in FIG. 7, can be screwed into the female threads 32*d* of the adapter assembly to prevent leakage. The plug need not be threaded; it can alternatively be a magnetic or expansion type. In the alternate cases, there is also no need for female threads 32*d* on the adapter 30.

As shown in FIG. 1, the length of the lower liner fitment 26 and the width of the proximal end of the adapter assembly within the container is relatively small compared to the diameter of the lower liner fitment 26. Therefore, when the flexible liner is filled, the portion of the liner proximal to the lower liner fitment is not disposed a great distance from the interior walls of the container 12. If this distance were greater, the liner would tend to stretch from the point of its connection to the lower liner fitment toward the container walls. Too much stress could tear the liner. However, it has been found that as dimensioned, the magnitude of such stretching can be limited to an acceptable level. In addition, the flexible flange 26*a* of the lower liner fitment reinforces that portion of the liner which is subjected to the undesirable stretching to the greatest extent.

In addition, due to the flat 34*b* of the flange 34 of the adapter assembly 30 and the flexibility of the flange 26*a* of the discharge fitment 26, the outlet of the flexible liner 20 can be disposed at a relatively low level, such that it minimizes the amount of stored contents that cannot drain through the discharge port because they settle below the height of the outlet. To further minimize such waste, the inside bottom of the container 12 can be custom-fitted with an insert that displaces the unusable portion of the liner. This insert is preferably formed of a soft, flexible material to cover any sharp protrusions on the inside bottom of container 12 that might puncture the flexible liner 20.

A method of inserting the flexible liner within the rigid container will now be described.

Initially, the adapter assembly 30 is screwed onto the lower liner fitment 26 of an unused liner 20. A bottom flat 34*c* of the adapter assembly should be aligned with the bottom of the liner. Teflon™ tape or a pipe sealant can be used to improve the sealing between the adapter assembly and the lower liner fitment. Next, the plug assembly 70 is threaded into the distal end of the adapter assembly. An arrow should be marked on the plug assembly designating "up", which points away from the bottom flat 34*c* of the adapter assembly. Then the plastic bung 24 from the top liner fitment 22 is removed so that excess air can escape while inserting the liner. The cap 16 is removed from the container lid 14 to expose the access aperture 14*a*. The plug 70 is detachably connected to a first end of a guide leash or tow-line 72 by way of a connector 72*a*. A magnet 74 is affixed to the free end of the guide leash 72.

Figure 8:
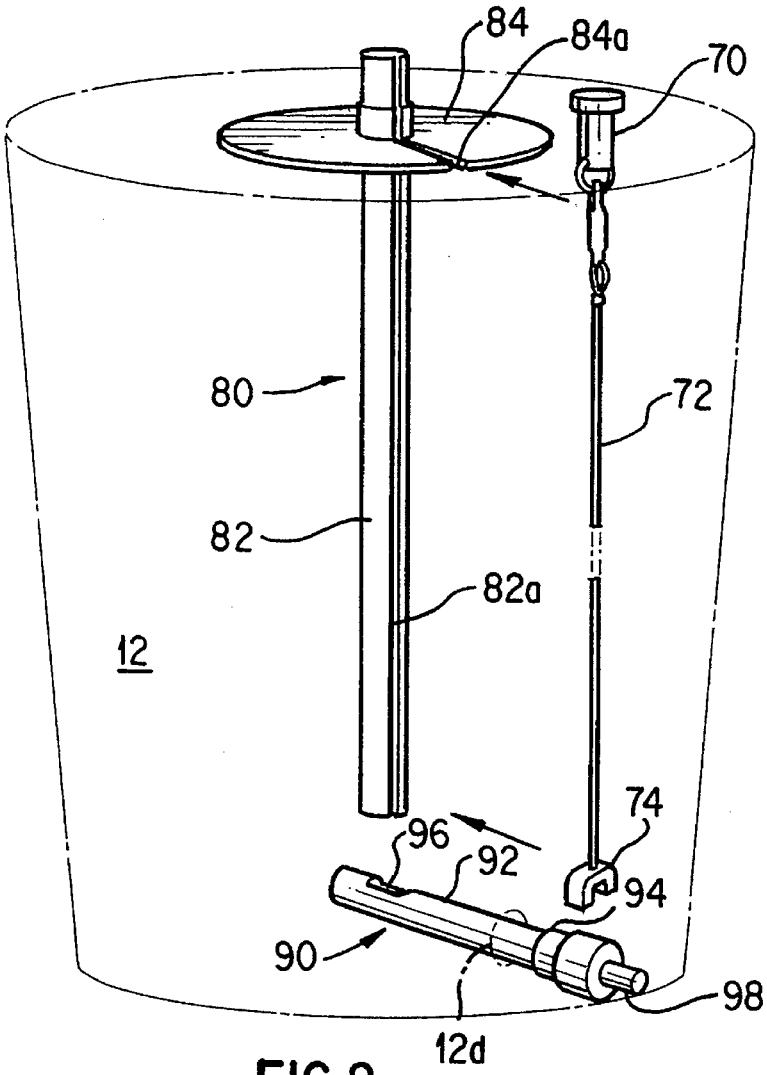
FIG. 8 is a perspective view of the positioning of the vertical and horizontal guide tubes for use in installing a liner in a bulk container of the present invention.
Figure 6:
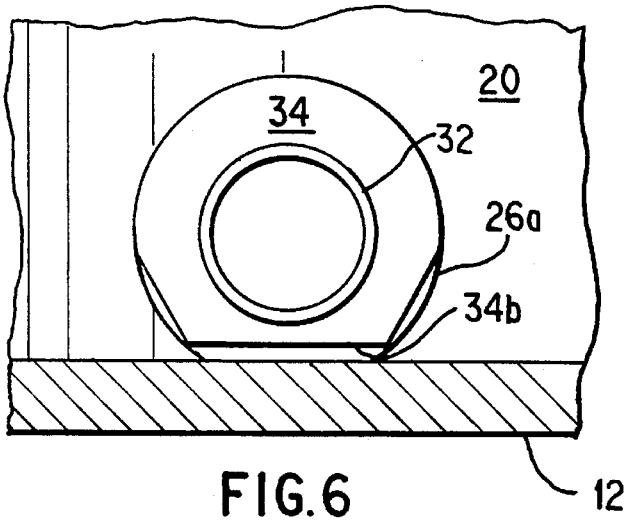
FIG. 6 is a sectional view taken along section line VI–VI' in FIG. 1 of the liner and adapter assembly installed in the bulk container of the present invention.

A vertical guide tube 80 is then inserted downwardly through the access aperture in the lid of the bulk container, as shown in FIG. 8. The vertical guide tube 80 is comprised of a tubular member 82 having a longitudinal slot 82*a* provided therein and a drop guard 84, also having a slot 84*a* formed therein. The slots 82*a* and 84*a* are aligned so that one side of the vertical guide tube is completely open. The inner diameter of the tubular member 82 is larger than the largest dimension of the magnet 74 attached to the guide leash 72, but smaller than the diameter of the plug 70. The slots 82*a* and 84*a* have a width wider than the diameter of the guide leash 72. The guard 84 has a diameter greater than the diameter of the access aperture 14*a* of the lid 14, such that the vertical guide tube can never accidentally drop completely into the bulk container. The vertical guide tube is formed of PVC or some other non-magnetic material that will not interfere with free passage of the magnet 74. The tubular member 82 and the guard 84 can be glued together with a PVC cement, for example.

Next, a horizontal guide tube 90 is inserted through the discharge port 12*d* of the bulk container 12. The horizontal guide tube 90 includes a tubular member 92, a guide shoulder 94, a metal plate 96, and a handle 98. All of the components of the horizontal guide tube 90, with the exception of the metal plate 96, can also be made of PVC and glued together with an appropriate cement. The metal plate 96 is preferably made of a ferrous metal to attract the magnet 74 attached to the guide leash 72. The plate 96 is disposed in a recess of the tubular member 92 to house the magnet 74 after it is attracted to the plate. The guide shoulder 94 is dimensioned so as to snugly fit within the discharge port 12*d* of the bulk container 12, such that the horizontal guide tube can be held substantially horizontally within the bulk container with the plate 96 being positioned precisely below the vertical guide tube 80.

When the vertical guide tube 80 and the horizontal guide tube 90 are in position, the magnet on the guide leash is inserted into the top of the vertical guide tube and lowered until it makes contact with the plate 96 on the horizontal guide tube. The horizontal guide tube is then removed from the discharge port of the tank with the magnet attached to plate 96. Then the vertical guide tube is removed from the access aperture while retaining the guide leash in place. The guide leash will slip out of the slot 82*a* on the tubular member 82 and out of the slot 84*a* of the guard 84 of the vertical guide tube.

The new liner 20 is then inserted into the container through the access aperture with the portion of the liner that includes the top fitment remaining outside the container. Using the guide leash, which is connected to the plug 70, which in turn is threaded onto the adapter assembly 30, the adapter assembly is pulled through the discharge port 12*d* of the bulk container 12 until the gasket 40 contacts the inner surface of the container and the flat 34*b* of the flange 34 is properly seated against the bottom on the inner surface of the bulk container. The flange will be properly seated in the recess of the bulk container when the previously noted arrow on the plug is pointed upwards. Then the retainer nut 50 is threaded onto the straight male threads 32*c* of the adapter assembly 30 and tightened with a wrench. The plug 70 can be removed from the adapter assembly and a valve 60, such as a ball valve, can be threaded onto the tapered male threads 32*b* of the adapter assembly.

Next, the lanyard 17 is affixed to the top liner fitment 22. The liner can then be filled with the desired liquid. To ensure unimpeded filling, the liner may first be inflated using a compressed air source. In filling the liner 20, use can be made of a circular fill plate having both a diameter greater than the diameter of the access aperture and a slot into which an annular recess of a reinforced neck of the top liner fitment can slide. The fill plate can rest on the rim of the access aperture and support the upper liner fitment during filling. Then, the bung plug 24 is replaced in the top liner fitment 22. Afterwards, the cap 16 can be replaced in the access aperture 14*a* and the bulk container is ready for use. A sight gauge can be placed in the discharge line upstream of the valve 60 to indicate the fluid level in the container 10.

When the contents of the container have been exhausted, the liner can be replaced. First, the valve 60 and the retainer nut 50 are removed from the distal end of the adapter assembly 30. Then the plug assembly with the guide leash connected thereto is replaced into the adapter assembly. Next the adapter assembly 30 with the affixed plug are pushed back into the container. The plug will prevent any residual contents within the liner from leaking into the container during removal. Next the cap from the container lid is removed and the lanyard 16*c* is used to pull the top end of the liner out of the access aperture. The entire liner is then pulled out of the container through the access aperture, making sure the magnet end of the guide leash is not pulled through the discharge port 12*d* of the bulk container. Then the adapter assembly is removed from the used liner (and cleaned, if necessary) and attached to a new liner. The insertion process described previously is repeated. However, there is no need to utilize the vertical guide tube 80 or the horizontal guide tube 90, since the guide leash is already in place.

It should be understood that the preferred embodiment described herein is intended only in an illustrative, rather than a limiting, sense. The true scope of the invention is set forth in the claims appended hereto.

We claim:

1. A lined container comprising:

a rigid-walled vessel having a wall and a port formed in said wall;

a flexible liner having a discharge fitment integrally provided therewith, said fitment having female threads;

an adapter comprising a tubular member having a proximal end, a distal end, and a coaxial bore, for connecting said fitment of said flexible liner to said port of said vessel, and a flange member, secured to said tubular member, for abutting against an interior surface of the wall of said vessel, wherein the distal end of said adapter extends through the port of said rigid-walled vessel.

2. A container according to claim 1, wherein said adapter includes a first set of tapered threads on the proximal end thereof for engaging with the threads of the fitment of said flexible liner.

3. A container according to claim 1, wherein said flange member is disposed closer to the proximal end of said adapter, which connects to the fitment of said flexible liner, than the distal end.

4. A container according to claim 1, wherein the fitment comprises substantially a hollow cylinder having an outer diameter, an inner diameter, and a length, and wherein the ratio of the outer diameter to the length of the fitment of said flexible liner is no less than 2.6 to 1.

5. A container according to claim 4, wherein the average inner diameter of said fitment is no more than 9.5 times its average thickness.

6. A lined container comprising:

a rigid-walled vessel having a wall and a port formed in said wall;

a flexible liner having a discharge fitment integrally provided therewith, said fitment having female threads; and an adapter comprising a tubular member having a proximal end, a distal end, and a coaxial bore, for connecting said fitment of said flexible liner to said port of said vessel, and a flange member, secured to said tubular member, for abutting against an interior surface of the wall of said vessel, wherein a sealing ring is provided between said flange member and the interior surface of the wall of said vessel.

7. A container according to claim 6, wherein said flange member of said adapter is substantially circular, but with a flat section on its circumference, the flat section being engageable with a flat surface of said vessel to prevent rotation of said adapter.

8. A lined container comprising:

a rigid-walled vessel having a wall and a port formed in said wall;

a flexible liner having a discharge fitment integrally provided therewith, said fitment having female threads;

an adapter comprising a tubular member having a proximal end, a distal end, and a coaxial bore, for connecting said fitment of said flexible liner to said port of said vessel, and a flange member, secured to said tubular member, for abutting against an interior surface of the wall of said vessel, wherein said adapter includes a first set of tapered threads on the proximal end thereof for engaging with the threads of the fitment of said flexible liner, and said adapter is further provided with second and third sets of threads, the second set of threads being provided near the distal end of said adapter and comprising a set of male, straight threads for engaging with threads on a securing member, the securing member for abutting against an exterior surface of said vessel, and the third set of threads is provided at the distal end and comprises male tapered threads for providing an interference fit with a female-threaded valve.

9. A container according to claim 8, wherein the third set of threads of said adapter is formed continuously with the second set of threads.

10. A container according to claim 8, wherein the securing member comprises a nut that is tightened against the exterior surface of said vessel when the nut is in its securing position.

11. A container according to claim 8, wherein said adapter comprises a fourth set of threads, which are female, provided in the coaxial bore at the distal end of said adapter for engaging with male threads on a plug member for the bore.

* * * * *